US010213006B1

(12) United States Patent
Chung

(10) Patent No.: US 10,213,006 B1
(45) Date of Patent: Feb. 26, 2019

(54) EYELASH GRASPER DEVICE FOR REMOVING MASCARA FROM THE EYELASHES AND METHOD OF USING

(71) Applicant: Salomie Chung, Miami, FL (US)

(72) Inventor: Salomie Chung, Miami, FL (US)

( * ) Notice: Subject to any disclaimer, the term of this patent is extended or adjusted under 35 U.S.C. 154(b) by 0 days.

(21) Appl. No.: 13/964,019

(22) Filed: Aug. 9, 2013

Related U.S. Application Data

(60) Provisional application No. 61/742,381, filed on Aug. 9, 2012.

(51) Int. Cl.
*A45D 40/30* (2006.01)
*A45D 44/00* (2006.01)

(52) U.S. Cl.
CPC ..... *A45D 44/00* (2013.01)

(58) Field of Classification Search
CPC ..... G04D 1/021; A61B 2017/305; A61B 2018/1462; A45D 44/00
USPC ..... 132/216, 200, 212, 217, 218, 270, 317, 132/320, 333, 108, 314, 315; 401/9–11, 401/261, 266, 201; 206/581, 823, 207, 206/210, 230; 15/107, 118, 209.1, 210.1, 15/227, 244.1, 244.4; 606/205, 206, 210, 606/211; 604/1; 294/99.2
See application file for complete search history.

(56) References Cited

U.S. PATENT DOCUMENTS 2,489,099 A * 11/1949 Marcellus ..... 132/217
2,569,246 A * 9/1951 Marcellus ..... 132/217
2,635,611 A * 4/1953 Marcellus ..... 132/217
2,908,923 A * 10/1959 Schlechter ..... 401/10
3,016,059 A * 1/1962 Hutton ..... 132/217
3,367,336 A * 2/1968 Eizenberg ..... 606/210
3,495,918 A * 2/1970 Ragnvald ..... 401/201
3,648,702 A * 3/1972 Bean ..... 606/210
3,738,366 A * 6/1973 Blomberg ..... 606/210
3,906,957 A * 9/1975 Weston ..... 606/205
4,457,756 A * 7/1984 Kern ..... A61B 17/12022 424/434
4,746,238 A * 5/1988 Levine ..... 401/196
4,750,771 A * 6/1988 Emmett et al. ..... 294/99.2
4,955,896 A * 9/1990 Freeman ..... 606/210
4,964,663 A * 10/1990 Jermyn ..... A61F 9/0061 294/1.2

(Continued)

FOREIGN PATENT DOCUMENTS

GB 2118436 A * 11/1983 ..... A45D 34/04

*Primary Examiner* — Rachel R Steitz
(74) *Attorney, Agent, or Firm* — Susan Dierenfeldt-Troy

(57) ABSTRACT

The device includes two movable elongated arms with a stationary distal end and a movable wing portion at each proximal end of the elongated arms for slidingly and reversibly receiving disposable absorbent oval-shaped sleeves for effecting the transfer of dissolved or softened mascara from the eyelash to the sleeves when the invention is practiced. One of the elongated arms includes a domed stop disk on its inner surface to prevent damaging pressure on the eyelash during usage. The device provides for the safe and efficient removal of mascara from both the top and bottom surfaces of the eyelashes by causing the gentle encasement of the eyelashes between the two absorbent sleeves during usage. The invention includes a self-contained unit for both transporting the device and providing tools for the hands-free insertion of the sleeves onto the wing portions and hands-free removal of soiled sleeves from the wing portions.

1 Claim, 10 Drawing Sheets

(56) References Cited

U.S. PATENT DOCUMENTS

| | | | | |
|---|---|---|---|---|
| 5,047,049 | A * | 9/1991 | Salai | 606/205 |
| 5,212,847 | A * | 5/1993 | Melcher et al. | 15/244.1 |
| 5,307,826 | A * | 5/1994 | Iosilevich | 132/218 |
| 5,330,056 | A * | 7/1994 | de la Rocha | 206/581 |
| 5,334,215 | A * | 8/1994 | Chen | 606/210 |
| 5,855,214 | A * | 1/1999 | Heneghan | 132/320 |
| 5,876,420 | A * | 3/1999 | Noll et al. | 606/208 |
| 6,079,423 | A * | 6/2000 | Suzuki | 132/320 |
| 7,517,166 | B2 * | 4/2009 | Keck | 401/7 |
| 8,048,107 | B2 * | 11/2011 | Chen | 606/210 |
| 8,127,776 | B2 * | 3/2012 | Green | 132/216 |
| 2003/0233119 | A1 * | 12/2003 | Tiedemann | A61B 17/062 606/210 |
| 2004/0071494 | A1 * | 4/2004 | Staniforth et al. | 401/262 |
| 2004/0161290 | A1 * | 8/2004 | Puvvada et al. | 401/201 |
| 2007/0163613 | A1 * | 7/2007 | Lee | 132/216 |
| 2008/0142405 | A1 * | 6/2008 | Knapp et al. | 206/581 |
| 2008/0298879 | A1 * | 12/2008 | Chesak et al. | 401/133 |
| 2012/0126556 | A1 * | 5/2012 | Wu et al. | 294/99.2 |

* cited by examiner

EYELASH GRASPER DEVICE FOR REMOVING MASCARA FROM THE EYELASHES AND METHOD OF USING

PRIORITY CLAIM

This application claims priority from provisional patent application No. 61/742,381 filed on Aug. 9, 2012.

FIELD OF THE INVENTION

The invention relates generally to cosmetic devices and more particularly to a device for removing mascara from the eyelashes. The device includes a non-disposable unit for securing disposable absorbent sleeves in their proper orientation during the mascara removal process. The device and its associated method of use provide for the safe and effective removal of mascara from the eyelashes. The invention further includes a portable container for storing the grasper device, loading disposable absorbent sleeves onto the grasper device, and removing soiled sleeves from the device.

BACKGROUND OF THE INVENTION

Mascara is a type of synthetic, polymer-based eye makeup specifically for the eyelashes that is used by tens of millions of women on a daily basis. The mascara polymer is generally presented in a viscous liquid or a paste form. It is generally sold as part of a self-contained unit consisting of a mascara-holding reservoir and an applicator wand. Mascara is typically applied to the eyelash by first coating the wand's bristles with the mascara and then rolling or running the mascara-coated wand through the eyelashes.

Mascara is intended to stick to the eyelashes until being removed with mascara remover. Runny mascara could pose an infection danger to the eyes if it gets into the actual eye. Furthermore, runny mascara can result in an unattractive raccoon eye appearance particularly if mascara coated onto the lower eyelashes becomes runny. Over the years, waterproof mascara compositions have been invented to address these mascara-eyelash sticking deficiencies and maximizing the adherence of mascara to eyelashes even in very hot, humid conditions. See, e.g., patent U.S. Pat. Nos. 7,883,690 and 8,388,940.

Mascara, no matter what the composition, is intended to be removed before the wearer retires for the night. Failure to do so may result in an eye infection or other problems if flakes of the dried-on mascara enter the eye. Moreover, many mascara users may wish to freshen their eyelashes by applying new mascara, for example, before attending an evening function. The proper application of new mascara, however, generally first requires the removal of the previously applied, but now dried-on, mascara. Waterproof mascaras can be particularly challenging to remove and require the use of specialized liquid makeup removers. Furthermore, the poor accessibility of the sides of the individual eyelashes can impede the efficient and thorough removal of mascara.

Mascara removal is generally a two-step process conducted in front of a mirror. First, the user applies a liquid or viscous solvent to the eyelashes to soften or dissolve the dried-on mascara. The liquid mascara remover is applied to the mascara-coated eyelashes by the user with her fingers or with a tissue, cotton ball, or compressed cotton pad ("Swab") that has been saturated with the liquid mascara remover.

Second, the user then presses or dabs a Swab against the eyelash to effect transfer of the softened or dissolved mascara from the eyelash onto the Swab. Several Swabs may be required to effect complete removal of the dissolved mascara.

The mascara-to-Swab transfer step is associated with several problems. For example, the Swab may shed fibers, causing the fibers to become intertwined with the eyelashes. These fibers can be difficult to retrieve and can be a nuisance whenever the eye blinks and the threads appear in the person's line of vision.

Another problem often arises in particular with tissue or pad types of Swabs due to the manner in which they are often used. Typically the tissue or cotton pad Swab is first positioned under the upper eyelash and then folded over so as to encase the eyelash between a bottom tissue (or pad) layer and an upper tissue (or pad) layer to help facilitate removal of mascara from all parts of the individual eyelashes that make up the person's band of eyelashes. In performing this step, the user may inadvertently apply an undue amount of pressure on the eyelash while pressing the tissue (or pad) layers against the sandwiched eyelash. Some tissue (or pad) users may also carry out what is essentially an eyelash "wiping" step wherein the folded tissue (or pad) is pulled upwardly over the top edge of the sandwiched eyelashes to help facilitate removal of the mascara from the bottom, lid-bordering part of the eyelashes to the top of the eyelashes. Any contact with an individual eyelash involving an undue amount of pressure and/or a pulling effect may cause an eyelash(s) to actually come off during the mascara removal process.

A third problem often arises when the Swab is used to transfer liquid makeup remover to the eye. An over-saturated Swab may cause the liquid mascara remover to get into the eye. This problem has been somewhat ameliorated through the market introduction of mascara-remover impregnated pads, but these pads still require the user to press them against the eyelashes and exert sufficient pressure/contact to deliver the remover without pulling off an eyelash.

A fourth problem with the Swab approach stems from the very shape of the eyelid. The inner corners of the eyelids can be particularly difficult to access, especially where the Swab is basically a one-size-fits-all-eyelid tool and is generally circular or rectangular in shape.

The prior art recognizes the aforesaid problems associated with the removal of dissolved mascara from the eyelashes as illustrated by the following prior art patents and patent publications. For example, U.S. Pat. No. 6,761,177 issued to Shaba, et al. for a Swab for Make-Up Removal invention is intended to provide for the precise removal of make-up in small areas including the eyelids as well as for touch-up purposes and consists of two flat triangularly-shaped swabs positioned at opposite ends of a flexible stick. The invention is more suitable for the application and removal of eye shadow than dried-on mascara.

WIPO publication no. WO/2007/096923 contemplates a device for removing mascara from eyelashes comprising a support rod with a plurality of holed multiple compressed cotton disks on one end of the support rod. The rod is capped at one end presumably to help keep the disks on the support rod. The cap is actually located at the end of the device that would be closest to the inner eyelashes, and thereby may well interfere with the efficient removal of mascara from the inner eyelashes. Furthermore, it appears that the entire inventive unit is meant to be disposable and not just the disks themselves. Even if only the disks themselves are meant to be disposable, it is unlikely that most consumers would want to spend time threading holed disks onto a support rod or removing soiled disks from the support rod.

U.S. Pat. No. 5,212,847 issued to Melcher for a Swab and Method of Manufacturing and Using It describes a Swab consisting of a disposable and autoclavable fibrous application pad formed with a narrow slit and a separate handle with barbs at one end. This invention becomes operational when the handle's barbed end inserted into the pad's narrow slit. As with the WIPO publication, the invention does provide a means of controlling the pressure exerted on the eyelash to deliver sufficient mascara mover without at the same time pulling out an eyelash. The handle only serves the purpose of providing a way to secure the pad to the handle. Furthermore, the make-up market is a mass consumer market. Makeup users do not have access to autoclaves, which are generally used for sterilization purposes in hospitals/medical facilities and manufacturing facilities.

U.S. Pat. No. 7,870,633 issued to L'Oreal as the assignee for a Deformable Fiber Pad Impregnated with Mascara Remover describes a deformable pad which can be folded or shaped to allow the user to more readily access the inner eyelashes to remove dissolved mascara. This invention, however, does not solve the other aforementioned problems generally associated with the removal of dissolved mascara. For example, the folded pad still does not mimic the overall shape of the eye and any sharp corner introduced into the folded pad may result in uncomfortable contact with the inner eyelashes and inner eyelid.

Another disadvantage of the prior art is that the user must hold onto the actual Swab while using it. Particularly where the swab is a tissue or pad, the user's fingers may obscure the user's line of vision as she gazes into the mirror, making it difficult to ascertain just where the eyelash is in relation to the Swab and vice versa. The user's inability to ascertain this relationship may cause her to accidently move the Swab very close to the actual eye. Should the Swab actually come into contact with the eye, the eye may become irritated or even sustain damage.

It would thus be advantageous to provide a device and method for the transfer of softened or dissolved mascara from the eyelash that simultaneously solves several of the foregoing problems by: 1) minimizing interference with the user's line of vision; 2) preventing the inadvertent removal of eyelashes as the result of undue pressure on the eyelashes; and 3) conforming to the shape of the eye to provide for effective mascara remover throughout the band of eyelashes from the inner eyelashes to the outer eyelashes.

Finally, the prior art generally requires the user to directly handle both clean Swabs and soiled Swabs during the mascara removal process. It would thus be advantageous to provide an invention that may be practiced by the user without the user ever having to handle the absorbent pads, whether clean, or soiled with dissolved mascara. Such a feature is desirable to help prevent the transmission of germs to the delicate eye area and/or to prevent the transfer of dissolved mascara from the soiled Swab to the user's fingers.

SUMMARY OF THE INVENTION

It is an objective of this invention to provide a mascara removal device and method of using for providing the safe and effective removal of mascara from the upper eyelash that eliminates the aforementioned problems associated with the actual removal of dissolved mascara from the eyelash. In an embodiment of the invention, there is provided a mascara removal implement which comprises an eyelash grasper with two elongated arm members affixed at their distal ends, each elongated arm member tapering into an angled wing portion at its proximal end for holding disposable, soft, absorbent padded sleeves which may be impregnated with mascara remover.

Preferably the implement includes a domed stopper disk to prevent the user from exerting excessive pressure on the eyelash while using the implement, thereby achieving the stated of objective of preventing an eyelash(s) from coming off during the mascara removal process.

The angle formed between the wing and its adjoining elongated arm is preferably an obtuse angle to provide an implement that can be readily oriented by the user so that the eyelash ridge is horizontally positioned between the implement's padded sleeves, thereby achieving the stated objective of minimizing interference with the user's line of vision during the mascara removal process because the user's hand and fingers are not in the way.

Preferably the device's disposable, soft, absorbent sleeves are oval or elliptical in shape to mimic the shape of the upper eyelash ridge, thereby achieving the stated objective of providing for the efficient removal of mascara from the entire upper band of eyelashes from the readily accessible outer eyelashes to the less accessible inner eyelashes.

The device is used by positioning the upper eyelashes horizontally within the space between the two pre-loaded absorbent padded sleeves when the grasper device is in its uncompressed or open position. By pressing the device's two elongated arms together, the two padded sleeves come into contact with both the front part and back part of the eyelashes simultaneously. Upon releasing the applied pressure, the user may repeat the eyelash-contacting step several times to create a "dabbing" effect to help facilitate removal of the mascara with the same set of pads or replace the pads and repeat the steps as desired.

Potential damage to the eyelashes is prevented by the domed stop disk located on the inner side of one of the elongated arms. The disk prevents the device user from unnecessarily applying excessive pressure on the elongated arms during usage and thereby reduces the possibility of removal of an eyelash during the mascara removal process.

Another embodiment of the invention includes a self-contained storage unit that includes an absorbent sleeve-loading station and a soiled absorbent sleeve-removing tool. The included absorbent sleeve-loading station and soiled-sleeve removing tool provide for the hands-free insertion of new sleeves onto the grasper device and removal of soiled sleeves, thereby meeting another objective of the invention: to eliminate the need for the user to actually touch either clean or soiled pads.

Another embodiment of the invention provides for a self-contained unit for both transporting the device and the disposable absorbent sleeves and includes an absorbent-sleeve holding station and a soiled sleeve removing tool.

Although the eyelash grasper device has features reminiscent of tweezers or forceps, the field of art specifically related to forceps/tweezers does not contemplate the inventive features of the present invention and teaches away from usage of forcep-like or tweezer-like implements so close the eye. For example, the dictionary defines forceps or tweezers as an instrument for grasping, holding firmly, or exerting traction upon objects especially for delicate operations (as by jewelers or surgeons). Often the grasping tips are sharply pointed where they are to be used, for example, in removing a sliver embedded in a person's skin or to groom eyebrows that are located along the person's brow bone by plucking stray eyebrow hairs. Pointed grasping tips are not desirable for any instrument to be used by the average consumer near the delicate eyelash area due to the eyelash ridge's proximity to the eye.

Moreover, the degree of traction exerted is dependent upon the application and the user's skill in handling the forceps/tweezers. Some objects to be grasped with tweezers/forceps, for example, a jewelry bead, are hardy and will not be damaged by tight grasping. As discussed above, excessive pressure on delicate eyelashes during the mascara removal process may cause an eyelash to come off. The present invention contemplates this possibility by providing a domed stop disk for preventing excessive pressure on the eyelash, in particular to overcome a possible incorrect perception by consumers that the tighter the contact between the absorbent sleeves, the more efficient the mascara removal.

Furthermore, the presence of soft absorbent sleeves on the tips of tweezers/forceps would defeat the purpose for which are they are currently used, e.g., to retrieve a jewelry bead, because the pads would interfere with the tips' grasping capability. The present invention does not contemplate grasping of eyelashes through very ends of the device's tips. Instead, the entire length of the device's two wings, upon insertion into the disposable, soft, absorbent sleeves, is involved in the mascara removal process.

Nor does the prior art as it relates to improvements to tweezers/forceps contemplate the present invention and method of use. For example, U.S. Pat. No. 4,634,165 issued to Russell and Keeler is for a forceps having replaceable tips. This invention meets the objective of ensuring that damaged tips for surgical forceps could be quickly replaced. The present invention does not involve tip replacement, and, in fact, sharp tips such as those present in surgical forceps or tweezers as described in '165 are not a desired feature of the present invention. As such, the '165 patent has no bearing on the present invention.

U.S. Pat. No. 6,866,314 issued to Cho is for padded tweezers. In this invention, the padded portion (finger touching pad) is not located at the tips, but instead is affixed to each pincer of the tweezer. The Cho invention is intended to solve problems related to grip and prevent formation of callouses and corns on the user's fingers with prolonged usage. Such features are desirable for users who must routinely use tweezers for extended periods of time, perhaps as part of their job, and are therefore particularly susceptible to callous formation. The present invention is not intended for use over extended period of time, and in contrast other applications involving tweezers or forceps, the user of the present invention will not be engaged in an activity requiring extreme mental concentration, such as, for example, when performing a medical procedure with forceps or tweezers. Again, prior art dedicated to improving the problems associated with the usage of tweezers/forceps for their typical applications in general have little bearing on the present invention.

Accordingly, the present device and method of usage comprise an innovation in the field of mascara removal that safely and effectively addresses problems with current mascara removal methods and/or devices. These together with additional objects, features, and advantages of the device and method of using will be readily apparent to those of ordinary skill in the art upon reading the following detailed description of the presently preferred, but nonetheless illustrative, embodiments of the present invention.

DETAILED DESCRIPTION OF THE INVENTION

Figure 1:
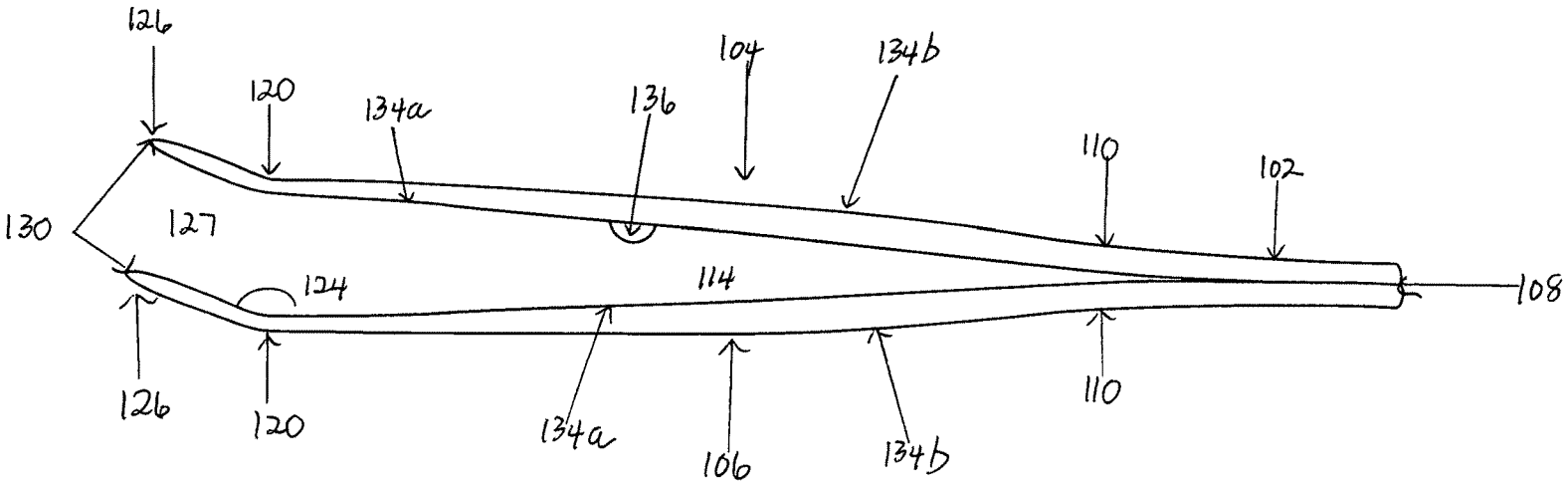
FIG. 1 is a perspective view of the grasper device without the inclusion of the disposable absorbent sleeves.

Referring now to FIG. 1, an eyelash grasper device for removing dried-on mascara from the upper and lower eyelashes is provided and designated 100. The eyelash grasper 100 generally comprises a body 102 with a first elongated arm member 104 and a second elongated arm member 106 fused together on their respective distal ends 110 to form a stationary end 108 of the body 102.

Each of the two elongated arm members 104 and 106 extends outwardly at an angle from the stationery end 108 to form a v-shaped opening 114 extending from the stationary end 108 to junction points 120 located at the proximal ends of each elongated arm. From its corresponding junction point 120, each elongated arm member 104 and 106, extends outwardly and upwardly to form a disposable absorbent sleeve-holding wing portion 126 resulting in the obtuse angle 124 where the junction point 120 is the vertex of the obtuse angle 124. Each elongated arm member 104 and 106 is contiguous with its respective disposable absorbent sleeve-holding wing portion 126. Each of the two absorbent sleeve-holding wing portions 126 tapers into a blunt or rounded absorbent sleeve-insertion end 130.

Referring again to FIG. 1, the two absorbent sleeve-holding wing portions 126 are parallel to each other and separated by opening 127 in the eyelash grasper's 100 resting position. Opening 127 is the space into which the eyelash is positioned in preparation for the mascara-removal step.

The preferred embodiment of the invention contemplates that the length of each absorbent sleeve-holding wing portion 126 will generally be substantially shorter than the length of the elongated arm members, 104 and 106, for handling reasons. In general, the disposable absorbent sleeve-holding wing portion is somewhat shorter than the width of the user's entire band of eyelashes, defined as the distance between the innermost eyelash(s) (i.e., those eyelashes near the bridge of the nose) and the outermost eyelash(s). The length of the absorbent sleeve-holding wing portion 126 is readily adaptable to accommodate a wide range of eyelash widths.

Referring again to FIG. 1A, approximately midway between juncture point 120 and the stationary end 108 of the body 102 on the inner side 134*a* of one of the elongated arm members 104 or 106 is affixed a domed, preferably plastic disk 136, wherein the domed side 138 of the disk 136 projects outwardly from inner side 134*a* into the v-shaped opening 114 and the opposite flat surface is affixed to the inner side 134*a*. When the grasper 100 is in its resting position as shown in FIG. 1, the domed stopper 136 disk is not in contact with the inner side 134*a* of the opposite elongated arm, 104 or 106. When the eyelash grasper 100 is in actual use, the domed stopper disk 136 prevents the user from inadvertently applying excessive pressure on the elongated arms 104 and 106 and therefore on the eyelashes themselves. As with standard mascara remover procedures, excessive pressure on the eyelashes may result in the loss of fragile, individual eyelashes, and the invention is intended to eliminate this problem.

The eyelash grasper device 100 may be made out of any suitable material or combination of materials such as stainless steel and/or rigid plastic. The entire body 100 need not be comprised of the same material. For example the elongated arms 104 and 106 may be comprised of stainless steel and the absorbent sleeve-holding wing portions 126 comprised of plastic.

Figure 4:
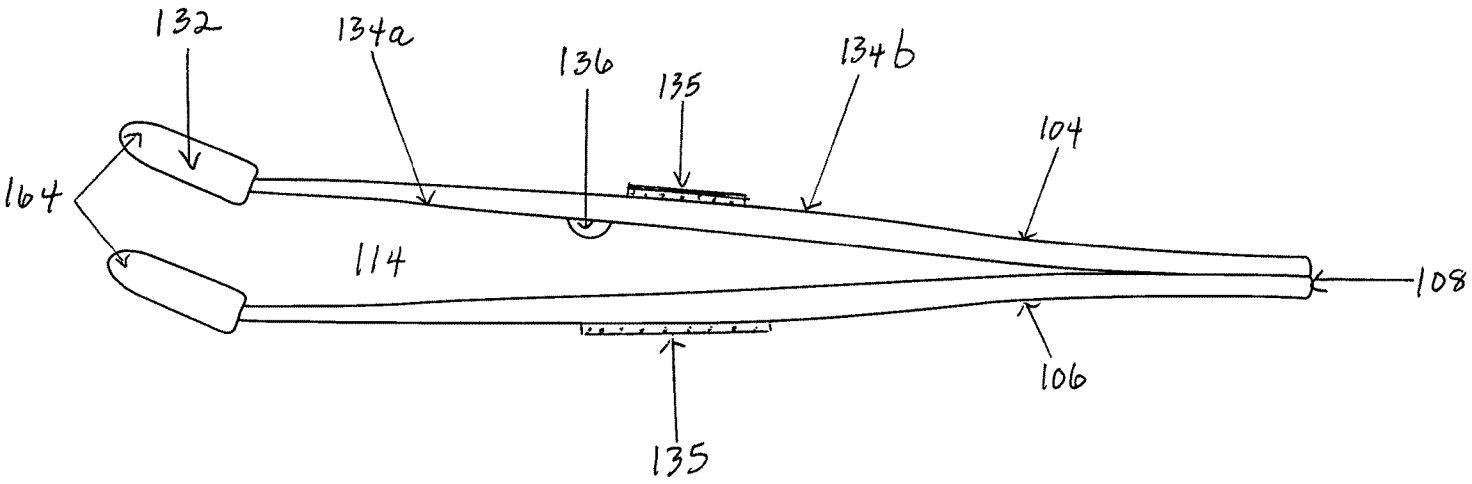
FIG. 4 is a perspective view of the grasper device showing the positioned disposable absorbent sleeves and elongated arms with a strip of slip resistant material.
Figure 9:
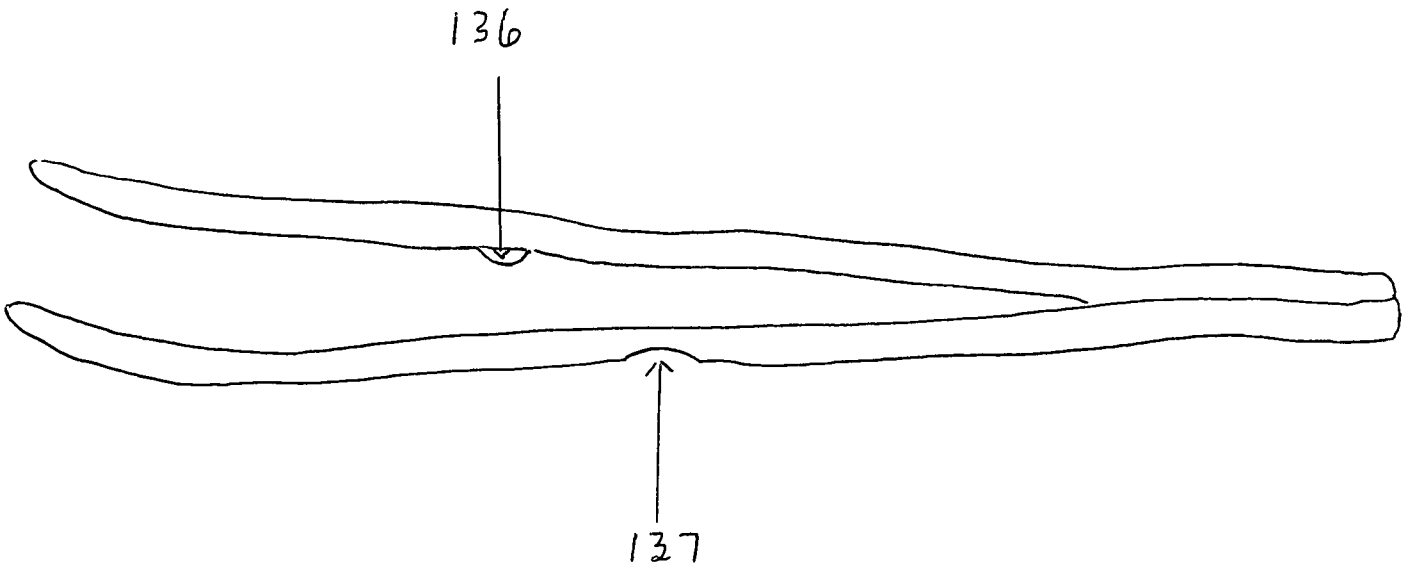
FIG. 9 is a perspective view of the device showing an indentation in the outer surface of each of device's elongated arms.

Referring to FIG. 4, it is further contemplated that at least a portion of the outer sides 134*b* of elongated arm members 104 and 106 may be covered by a strip of compressible, slip resistant material 135 such as rubber or the like. Referring to FIG. 9, in another embodiment, one or both of the elongated arm members 104 and 106 may also contain finger indentations 137 to help prevent slippage of the user's fingers during usage of the device.

Figure 2:
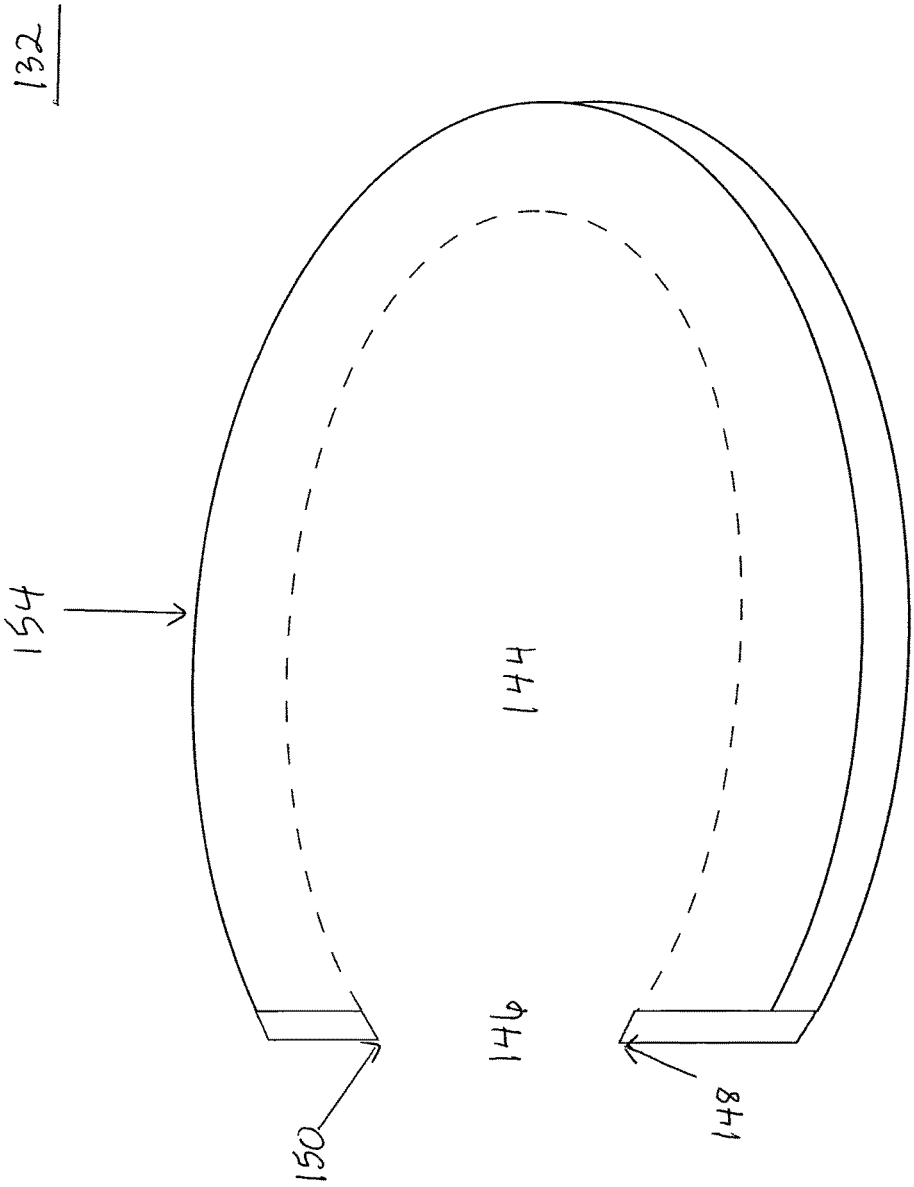
FIG. 2 is a top view of the disposable absorbent sleeve which shows how the inner and outer layers are affixed except at the slit opening to form an internal chamber for slidingly receiving the grasper device's wings.
Figure 3:
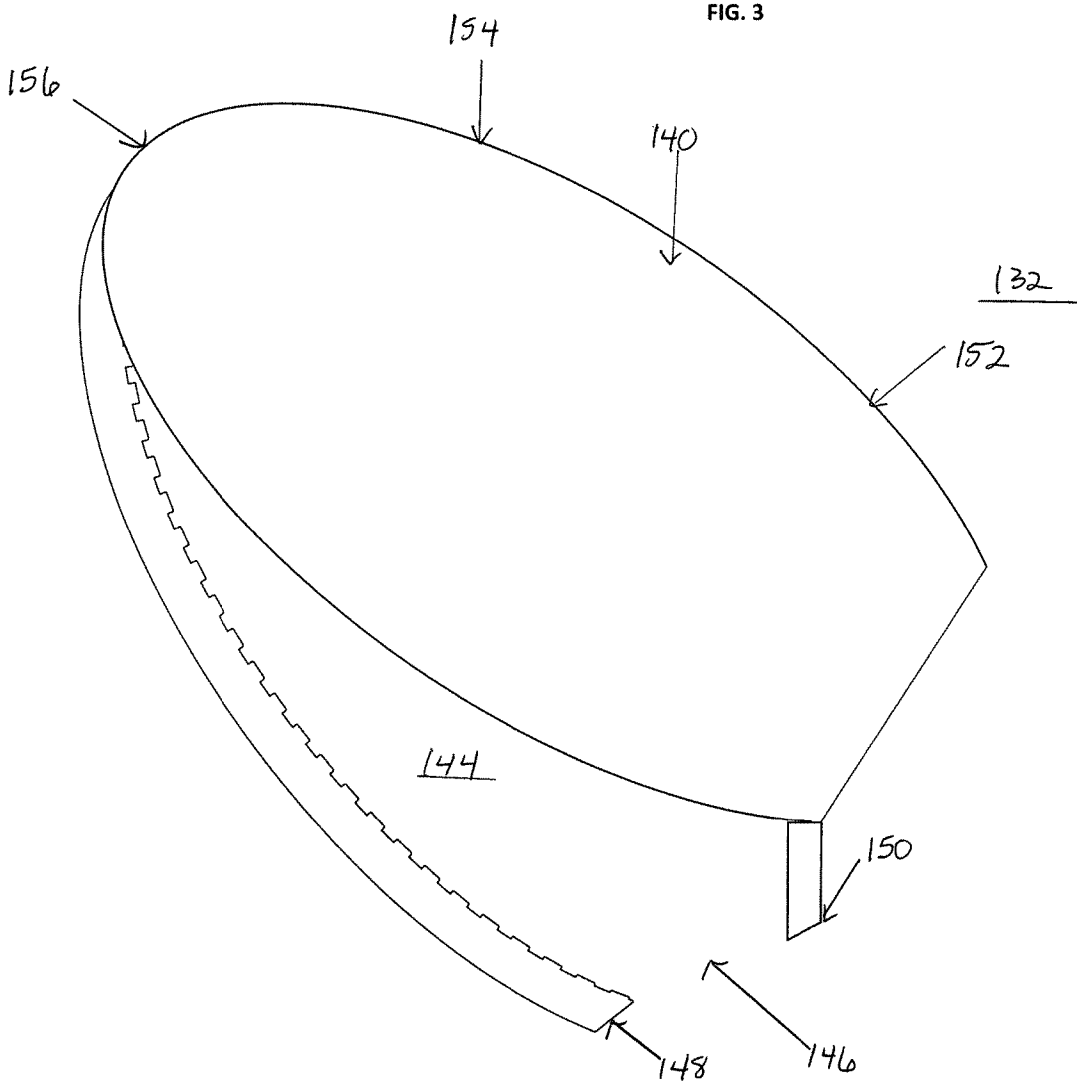
FIG. 3 is an exploded view of the disposable absorbent sleeve showing the inner chamber.

Referring now to FIGS. 2 and 3, the disposable absorbent sleeve 132 comprises a top layer 140 affixed to a bottom layer 142, both layers essentially in the shape of a contoured ellipse or oval to approximate the eyelid shape, an internal chamber 144, and a slit 146 at the distal end 148 of the disposable absorbent sleeve 132 for slidingly receiving the absorbent sleeve-holding wing portion 126. Top layer 140 is defined as that side of the disposable absorbent sleeve 132 which will actually come into contact with the eyelash during the method steps described below. The proximal end 156 of the sleeve 132 is rounded.

Top layer 140 and bottom layer 142 are affixed to each other at their edges starting from one lateral edge 148 of slit 146 and ending at the opposite lateral edge 150 of slit 146 to form internal chamber 144. When the absorbent sleeve-holding wing portion 126 is slidingly inserted through slit 146, the absorbent sleeve-holding wing portion 126 is nestled within disposable absorbent sleeve's 132 inner chamber 144.

The top and bottom layers 140 and 142 of disposable absorbent sleeve 132 are ideally comprised of soft, non-shedding, absorbent material such as compressed cotton and/or a polyester or other suitable material of sufficient thickness such that the sleeve-holding wing portions 126 will not be readily felt or noticed during the mascara removal method described below as part of this invention.

Figure 8:
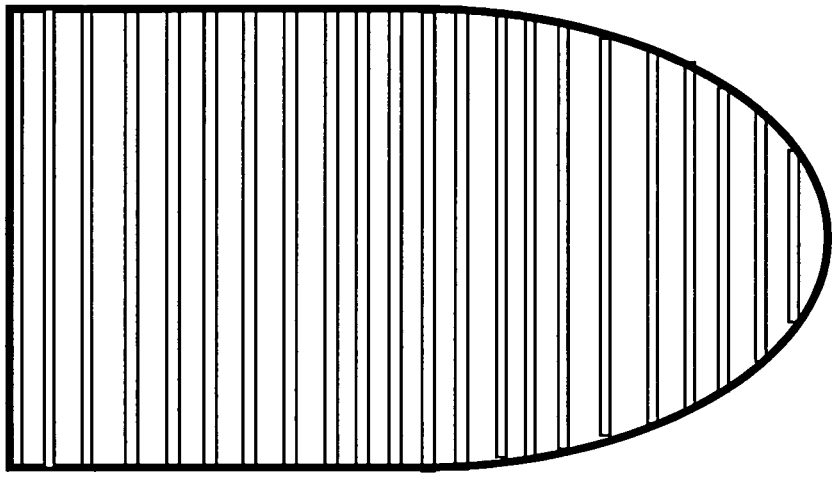
FIG. 8 is a top view of the disposable absorbent sleeve showing ridges of absorbent material running vertically between the curved edges of the disposable absorbent sleeve.

Referring now to FIG. 8, in an embodiment of the disposable absorbent sleeve 132, the top layer 140 or both layers 140 and 142 may comprise closely spaced, parallel ridges 152 of absorbent material running vertically between the curved edges 154 of the disposable absorbent sleeve 132. For orientation purposes, the bottom layer is defined as the layer of the absorbent sleeve 32 that will come into contact with the eyelash. Ridges 152 are contemplated to contribute to the efficiency of the mascara removal process with eye lash grasper 100 by both contributing additional surface area to the disposable absorbent sleeve 132 and separating mascara-coated eyelashes to more effectively remove dried-on mascara which may have accumulated on the sides of the individual eyelashes as well as on their top and bottom sides.

The disposable absorbent sleeves 132 may be inserted by hand onto both sleeve-holding wing portions 126 by simply sliding the blunt end 130 through slit 146 and gently pushing the wing portion 126 into the internal chamber 144 until the slit 146 is positioned at or slightly past the junction point 120. In general, the length of internal cavity 144 of the disposable absorbent sleeve 132 is sufficient to nestle substantially the entire length of sleeve-holding wing portion 126 from its blunt end 130 to the device's junction point 120.

Referring now to FIG. 2, the dimensions of the internal chamber 144 are sufficiently large to allow ready sliding of the sleeve-holding wing portion 126 from the slit opening 146 of the disposable absorbent sleeve 132 to the closed rounded end 156 opposite slit 146 of the sleeve 132 and further allow the fully inserted sleeve-holding wing portion 126 to remain in place during usage of the device. The edges 158 of internal cavity 144 are comprised of non-slippery compressed cotton or the like to provide a traction-like effect to help keep the inserted sleeve-holding portion 126 in place until it is manually removed by the user or removed using the soiled disposable sleeve removal cylinder tool 200 described below.

Referring now to FIG. 4, once the disposable absorbent sleeves 132 are properly positioned onto each of the eyelash grasper's sleeve-holding wing portions 126, the sleeve-holding wing portion 126 is no longer visible. Furthermore, the angled, vertical orientation of the pad-holding wing portions 126 hold the absorbent sleeves 132 in the proper orientation for the mascara removal method and until the user removes the disposable absorbent sleeve 132 from the sleeve-holding wing portion 126. Generally, the sleeve removal step will occur when sleeve 132 has become soiled with dissolved mascara. Once the disposable absorbent sleeves are properly inserted onto both of the mascara grasper's 100 sleeve-holding wing portions 126 to provide two (2) activated eyelash grabbing wings 164, the invention is practiced according to the following method.

Figure 5A:
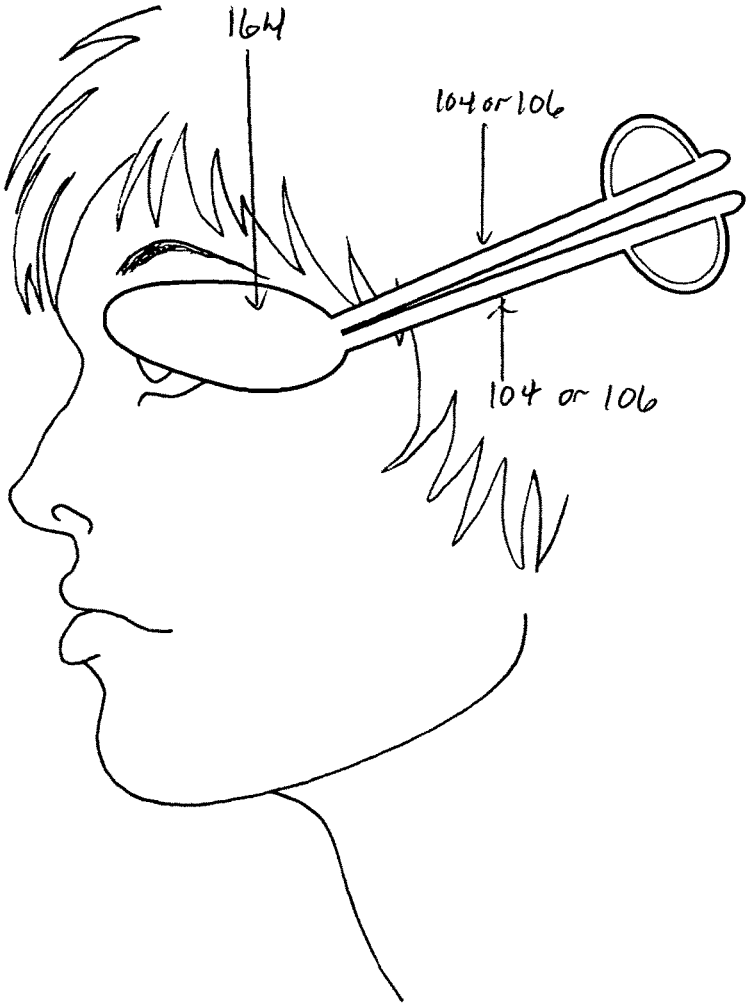
FIG. 5A is a profile side view of a human face showing the positioning of the disposable absorbent sleeves and the elongated arm members relative to the eyelash when the grasper device is in use.
Figure 5B:
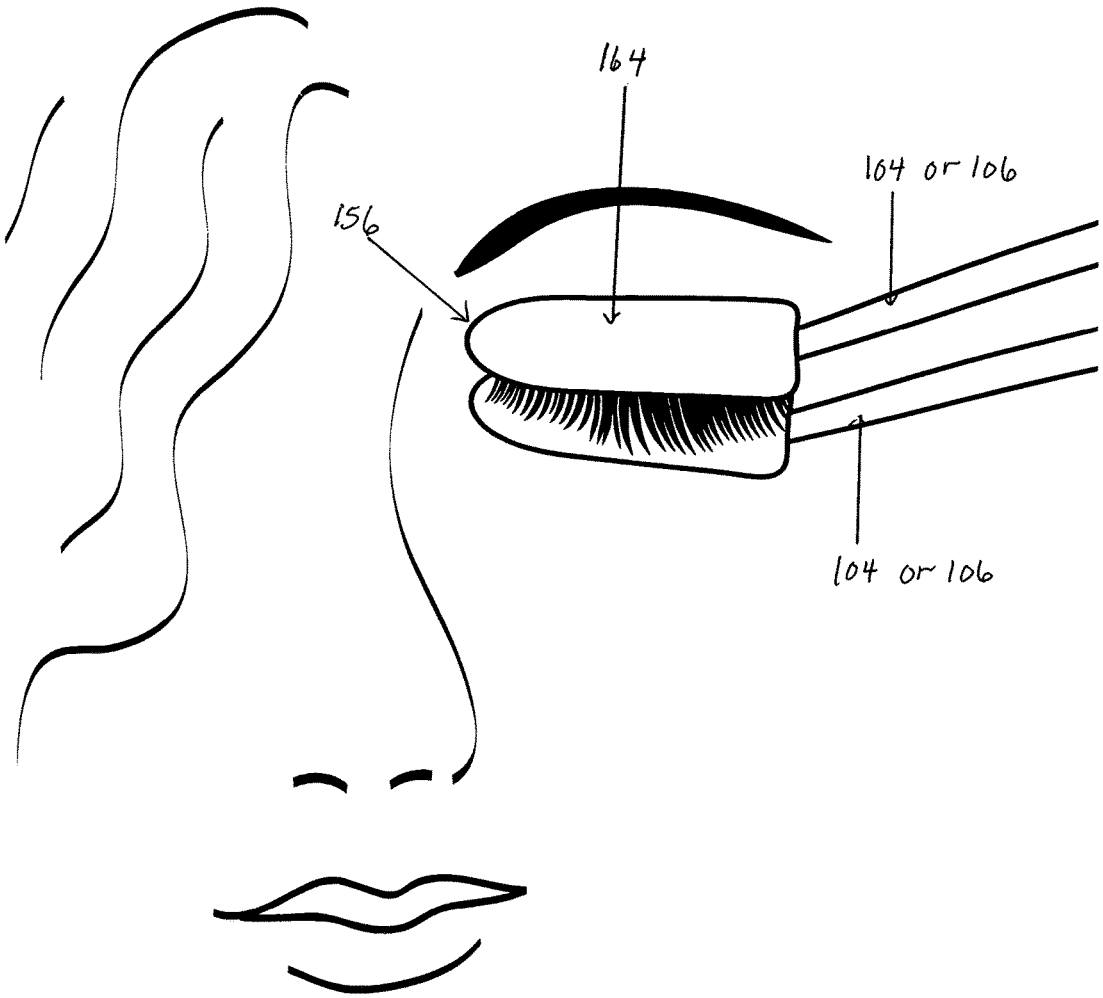
FIG. 5B is a front view of a human face showing the encasing of the eyelashes between the two disposable absorbent sleeves.

Step 1. Referring to FIGS. 4 and 5A and 5B, the eyelash grasper 100, still in its at-rest position 102 with the disposable, absorbent sleeves 132 already properly inserted onto both sleeve-holding wing portions 126, the user grasps the elongated arm members 104 and 106, typically between the thumb and the index finger and, without pressing the elongated arms 104 and 106 together, positions the selected eyelash, already coated with mascara remover, between the two activated eyelash grabbing wings 164 in the eyelash orientation space 127 wherein the proximal rounded end 156 of the disposable absorbent sleeve 132 is pointing towards the user's nose and the two activated eyelash grabbing wings 164 are each oriented lengthwise or substantially horizontally with the selected eyelash. It is contemplated that the user will place the thumb and index finger on any provided compressible slip resistant material 135 or indentations 137 provided on the outer sides 134*b* of the elongated arm members 104 and 106 to help maximize control of the grasper by the user while the grasper is being used near the eye.

Step 2. To remove dissolved mascara from selected eyelash, the user, with the same hand which is holding the eyelash grasper 100, then gently squeezes the elongated arm members 104 and 106 together to cause the activated eyelash grabbing wings 164 to simultaneously move towards eyelash and come into contact with both the eyelash's top and bottom sides. The domed stopper disk 136 prevents the user from applying excessive, potentially damaging pressure on the eyelashes.

Step 3. Reversal of the squeezing action will cause the two sleeve-holding wing portions 126 to move back to their at rest position 102. The user may wish to repeat steps 1 and 2 with the same sleeves 132 or fresh sleeves. With practice, the user will be able to quickly adjust the positioning of the selected eyelash between the two activated mascara remover wings 164 to achieve efficient mascara removal based on the shape and thickness of the user's own eyelashes, the type of mascara remover used, etc. The user can carry out the steps on different sections of the eyelash, including the difficult-to-access inner eyelashes by simply moving the activated mascara remover wings 164 as desired with the same set of absorbent sleeves horizontally along the band of eyelashes in the device's open position and then repeating step 2. The invention also contemplates the availability of different sizes of disposable absorbent sleeves 132 since eyelash shape and size do vary from user to user.

Step 4. Removing the soiled sleeves 132 from the sleeve-holding wing portions 126 manually or using the embodiment of the invention described below, and if desired, repeating steps 1-3 with a new pair of absorbent sleeves 132 by inserting the sleeves manually or using the sleeve loading station 180 described below.

The disposable absorbent sleeves 132, once positioned onto the sleeve-holding wing portions 126, may also be dipped into or otherwise brought into contact with mascara remover to deliver mascara remover to the eye by performing steps 1-3. The invention may thus be used to both deliver mascara remover to the eyelash and to remove the resulting dissolved mascara. Generally, the user would replace the disposable absorbent sleeves 132 used to deliver mascara remover to the eye with new pads to effect the efficient transfer of the dissolved mascara from the eyelashes onto pad 132. The ability of the device 100 to readily access both the top and bottom of the user's band of eyelashes to provide a particularly effective means of delivering lesser amounts of mascara remover to the eye and thereby address one of the problems often associated with mascara remover—dripping of mascara remover into the sensitive eye.

The invention also contemplates disposable absorbent sleeves already impregnated with mascara remover so that the user need not bother with a mascara remover separate from the mascara grasper device.

The grasper device 100 is intended for use with eyelashes which have been coated with liquid mascara remover as well as gels which are often used to remove mascara such as Vaseline®.

The above method for using the grasper device contemplates that the user will place the absorbent sleeves 132 onto the disposable absorbent sleeve-holding wings 126 by hand and also remove the resultant soiled sleeves by hand. For sanitation reasons, many users may, however, prefer an insertion and removal method that is hands-free. In addition, users may desire a container for storing and transporting the grasper device 100 and disposable absorbent sleeves 132. The invention therefore contemplates an embodiment wherein hands-free handling of new and soiled disposable absorbent sleeves 132 can be achieved with one self-contained unit 170 that also serves as a device 100 and sleeve 132 storage and transport container.

Figure 6:
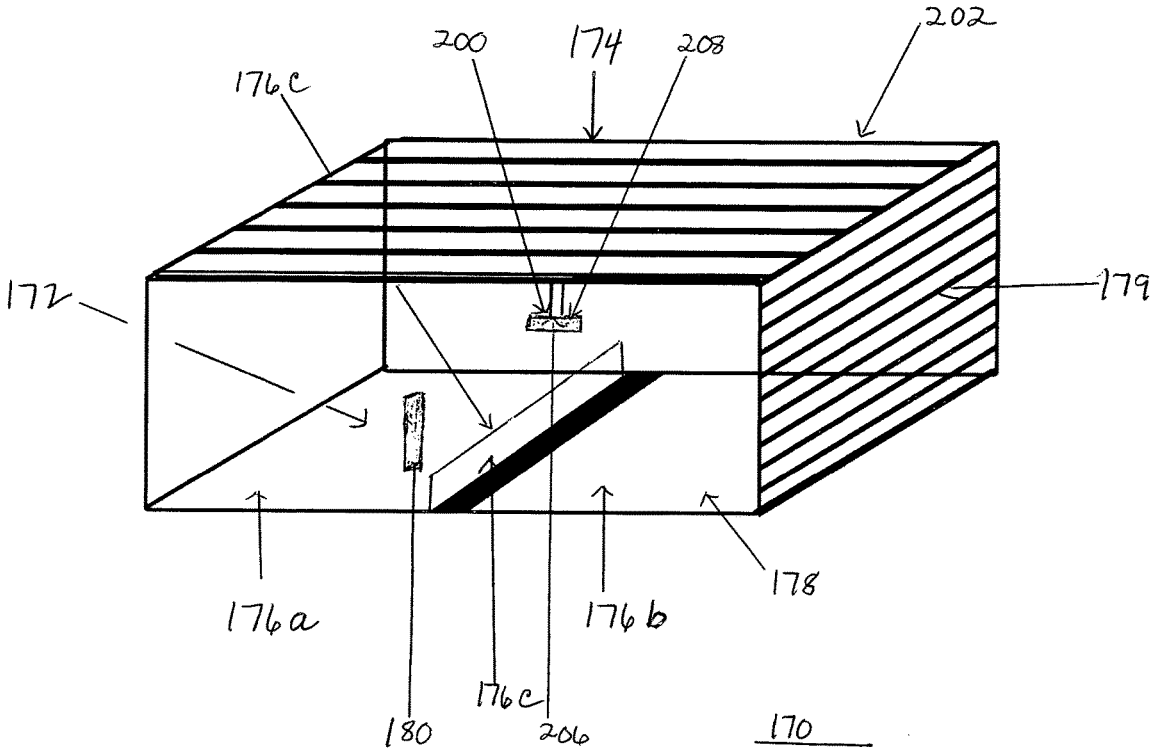
FIG. 6 is a perspective view of the self-contained storage unit for providing storage of the eyelash grasper device and unused disposable absorbent sleeves, a disposable absorbent sleeve-loading station, and a soiled absorbent sleeve-removal tool.
Figure 7A:
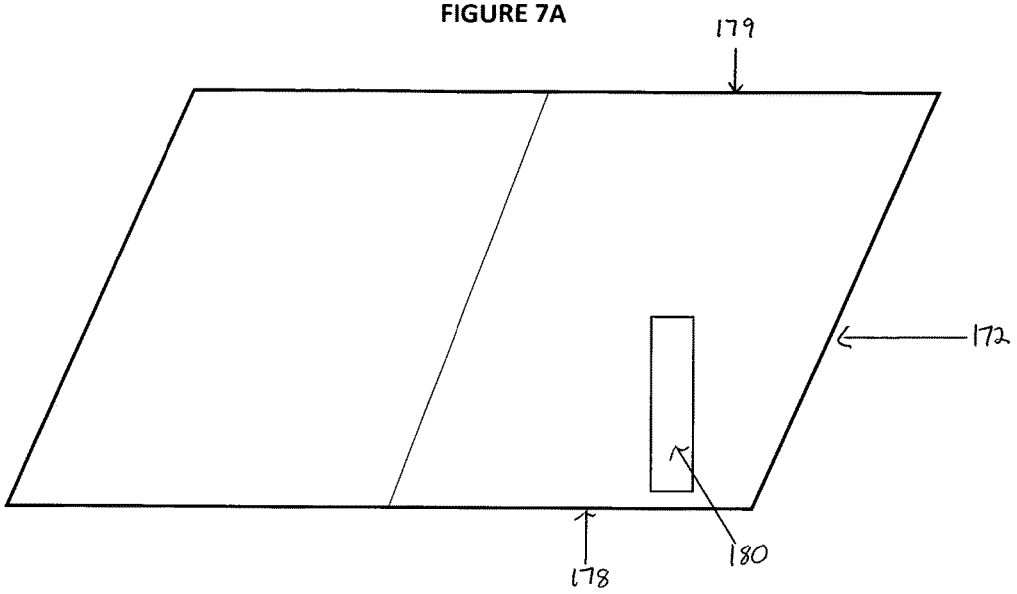
FIG. 7A is a top view of the absorbent sleeve-loading station projecting outwardly from the inside surface of the bottom chamber member.
Figure 7B:
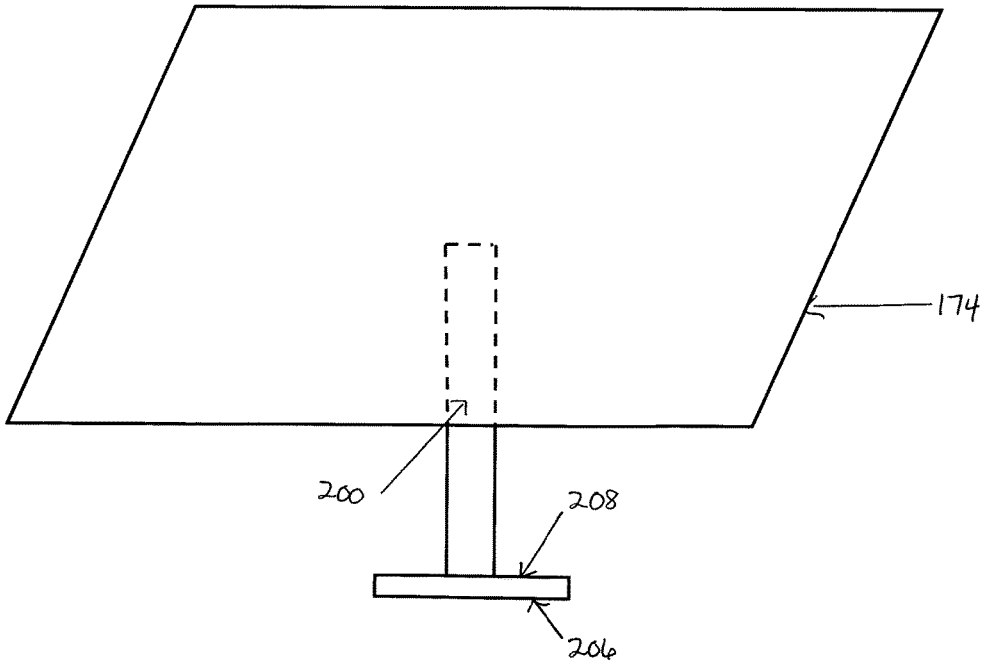
FIG. 7B is a top view of the inside of the top chamber member of the self-contained device transport and handling unit showing the soiled sleeve removal tool projecting outwardly from the inside surface of the unit's top chamber member.

Referring now to FIGS. 6 and 7A and 7B, an embodiment of the device includes self-contained unit 170 comprising a bottom chamber member 172 and a top lid member 174, both substantially in the shape of a rectangle wherein the bottom chamber member 172 and top lid member 174 are hingedly connected to provide a clam-shell type of opening and closing means 173. The bottom chamber member 172 comprises an eyelash grasper device 100 storage space 176*a*, a disposable absorbent sleeve 132 storage space 176*b* separated by a partition 176*c* affixed to the floor of the bottom chamber member 172 and extending from the front panel 178 to back panel 179 of the bottom chamber member 172 and at least one disposable absorbent sleeve-loading station 180 affixed to the inner surface of the bottom chamber member 172.

The sleeve-loading station 180 comprises a three-walled enclosure 182 with two opposite parallel sides 184 and a back side 186. The bottom edges of the sides 184 and the back side 186 are affixed to the inside surface of the bottom chamber member 172 to form a loading chamber floor 190. The distance between the two opposite parallel sides 184 is sufficiently narrow so as to keep the disposable absorbent sleeve 132 substantially in its vertical upright loading position 192 wherein the slit 146 is readily accessible to slidingly receive the sleeve-holding wing portion 126. The back side 186 helps keeps the absorbent sleeve 132 in its upright loading position 192 during the sleeve-insertion process. The sleeve loading station 180 is may be located in either of the storage spaces 176*a* or 176*b*.

The bottom storage member 172 may also contain two separate compartments 176*a* and 176*b* for holding unused absorbent disposable sleeves 132 as well as the grasper device 100. The compartments 176*a* and 176*b* are formed by a separator wall 176*c* which services to divide to the bottom storage member 172 into two storage compartments.

To load a new sleeve 132 onto the sleeve-holding wing portions 126, while holding onto the elongated arms 104 and 106 without pressing the arms together, the user then inserts the blunt end 130 of the disposable absorbent sleeve-holding wing portion 126 slidingly through the slit 146 and slidingly pushes the blunt end 130 into the inner chamber 144 until the proper placement is achieved as described above. The user then removes the now, absorbent sleeve-containing wing portion 126 from the sleeve-loading station 180 and repeats the step with the other sleeve-holding wing portion 126. Once the disposable absorbent sleeves 132 are inserted onto both of the both sleeve-holding wands 126, the grasper device 100 is in its activated position 164.

Referring to FIGS. 6 and 7B, the top chamber member 174 of the self-contained unit 170 comprises a soiled sleeve remover cylinder 200. One end of the cylinder 200 is affixed to and projects downwardly from the inner surface of the top chamber member 174 when the self-contained unit 170 is in its closed position. The cylinder 200 is exposed for usage when the self-contained unit 170 is in its opened position.

The width of the cylinder portion 200 is preferably less than 5 cm and the cylinder 200 may be rectangular or cylindrical in shape. The cylinder portion's 200's height is less than the height of the bottom chamber member 174's back and front panels and end panels. At the cylinder's top side 206 opposite the affixed end is affixed a protruding sleeve-catching rim or edge 208 which completely encircles the cylinder's top side 206.

When the user is ready to remove soiled disposable absorbent sleeves 132 from the grasper device 100, the user orients the sleeve 132-catching rim 206 between the soiled sleeves 132 such that the slits 146 are below the bottom side 210 of the sleeve-catching edge 208. The user then presses the elongated arms 104 and 106 together, and while keep the elongated arms 104 and 106 pressed together, the user pulls the grasper device 100 upwardly to cause the sleeve catching edge 208 to push the soiled sleeves off of both sleeve-holding wings 126 into top chamber 174. In this step, top chamber member 174 serves as a receptacle for soiled sleeves. The soiled sleeves can then be easily transferred to a waste receptacle by tipping the top chamber member 174 upside down without the user having to ever touch the soiled sleeves.

For ease of use and transport, one embodiment of the self-contained unit 170 comprises a clam-shell type of closure mechanism wherein the top and bottom members are hingedly connected together on one side only via a mechanism which allows allow the top chamber member 174 to be opened sufficiently to allow the user to be able have ready, unencumbered access to both the sleeve-removal cylinder 200 and the sleeve-loading station 180. In another embodiment, the top chamber member 174 and bottom chamber member 172 of the self-contained unit 170 may be further secured to reduce the possibility of accidental opening of the device during transport through a snap-like closure mechanism means or the usage of Velcro®.

The self-contained unit 170, the soiled sleeve removal tool 200 and the sleeve-loading station 180 are preferably comprised of plastic. The preferred embodiment describes a self-contained transport and absorbent sleeve 132-handling unit 170 wherein the tool 200 and sleeve-loading station 180 are nut both located in the same chambers 172 and 174, of the self-contained unit 170 because it is contemplated that the self-contained unit 170 will be used to transport and store clean disposable absorbent sleeves 132 in the bottom chamber 172. It thus may be desirable to ensure that clean disposable absorbent sleeves 132 do not come into contact with soiled sleeves.

Regarding the above detailed invention, directional terms such as "front", "back", "in", "out", "downward", "upper", "lower", and the like may have been used in the description. These terms are applicable to the embodiments shown and described in conjunction with the drawings. The terms are merely used for the purpose of description in connection with the drawings and do not necessarily apply to the positions in which the grasper device 100 and self-contained transport unit 170 may be used.

While the invention has been described with reference to preferred embodiment, it will be understood by those skilled in the art that various changes may be made and equivalents may be substituted for elements thereof without departing from the scope of the invention. In addition, many modifications could be made to adapt a particular situation or material to the teachings of the invention without departing from the essential scope of the invention thereof. It is therefore intended that the invention not be limited to the particular embodiment disclosed as the best more contemplated for carrying out this invention but that the invention will include all embodiments falling within the scope of the appended claims.

I claim:

1. A method of removing mascara from mascara-coated eyelashes using an actuated eyelash grasper, the eyelash grasper before actuation having:

a main body portion comprising a first and a second elongated arm member joined at a stationary distal end, each first and second elongated arm member having an inner smooth side and an outer smooth side and extending from the said stationery distal end along longitudinal lines to a proximal junction point in a variable relative position to provide a v-shaped variable space separating said first and second elongated arm members from each other wherein the said v-shaped variable space extends from the said stationery distal end to the said proximal junction point, with at least one of said first and second elongated arm members further comprising an optional strip of compressible, slip resistant material on said smooth outer side between said stationery distal end of said main body portion and said junction point;

a first wing portion permanently affixed at its distal end to said first elongated arm member's said proximal junction point and ending in a blunt end at its proximal end and a parallel second wing portion affixed at its distal end to said second elongated arm member's said proximal junction point and ending in a blunt and at its proximal end, each said first and second wing portion extending upwardly and outwardly from said affixed proximal junction point so as to form an obtuse angle with its said permanently affixed elongated arm member and wherein the said first and second wing portions extending from said junction points are parallel to each other and separated by a variable eyelash-grasping space;

a domed stopper disk comprising a flat side permanently affixed to the said inner smooth side of any one of the said elongated first or second arm members and a dome oppositely positioned from the said flat side and extending into the said v-shaped variable space separating said first and said second elongated arm members from each other, and a plurality of replaceable disposable absorbent sleeves substantially oval in shape comprising a top layer and a bottom layer with curved upper and lower edges, an internal cavity; a alit; and a rounded end opposite to said slit, and further comprising compressed cotton, polyester, or other absorbent material, and optionally, an impregnated mascara dissolving agent;

the method comprising:

a. assembling actuated eyelash grasper for use in removing mascara from eyelashes preferably pre-coated with mascara dissolving or softening agent by grasping said first elongated member while slidingly inserting said blunt end of said first wing portion through said slit and through said internal cavity of said disposable absorbent sleeve until said blunt end of said first wing portion is in substantial contact with said rounded end of said disposable absorbent sleeve; and grasping said second elongated member while slidingly inserting said blunt end of said second wing portion through said slit and through said internal cavity of said disposable absorbent sleeve until said blunt end of said second wing portion is in substantial contact with said rounded end of said disposable sleeve;

b. grasping said smooth outer sides of said first and second elongated arm members of said actuated eyelash grasper with the thumb and index finger positioned in any one of said concave indentations or against said compressible slip resistant material;

c. horizontally positioning eyelashes preferably previously coated with mascara dissolving or softening agent between said variable eyelash-grasping space separating said first wing portion of said actuated eyelash grasper from said second wing portion of said actuated eyelash grasper such that said rounded ends of said disposable absorbent sleeve, are pointed towards the bridge of the user's nose;

d. gently squeezing first and second elongated arms members together so as to cause said said first wing portion and said second wing portion to simultaneously move towards said horizontally-positioned eyelash until said actuated eyelash grasper's said first disposable absorbent sleeve comes into contact with top of said mascara-coated eyelashes and said second disposable absorbent sleeve comes into contact with bottom side of mascara-coated eyelashes;

e. maintaining contact between said mascara-coated eyelashes and said first and said second disposable sleeves a sufficient amount of time to provide for the transfer of said dissolved or softened mascara to said first and second disposable absorbent sleeves while being prevented from exerting eye-lash damaging pressure on said eyelashes by said domed stopper disk;

f. reversing said gentle squeezing action on said first and elongated arms to eliminate contact between said first and said second disposable absorbent sleeves and said eyelashes;

g. manually removing and discarding said first and second disposable absorbent sleeves from said first and second wing portions; and h. repeating steps a through g until mascara has been removed from the user's eyelashes to the user's satisfaction.

* * * * *